US011852429B1

(12) United States Patent
Dwyer et al.

(10) Patent No.: US 11,852,429 B1
(45) Date of Patent: Dec. 26, 2023

(54) WEAPON MAGAZINE RETAINER

(71) Applicant: Biofire Technologies Inc., Broomfield, CO (US)

(72) Inventors: Benjamin William Dwyer, Golden, CO (US); Bryan Edward Rogers, Aurora, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 17/806,861

(22) Filed: Jun. 14, 2022

Related U.S. Application Data

(60) Provisional application No. 63/211,285, filed on Jun. 16, 2021.

(51) Int. Cl.
*F41A 17/38* (2006.01)
*F41A 9/61* (2006.01)

(52) U.S. Cl.
CPC ..... *F41A 17/38* (2013.01); *F41A 9/61* (2013.01)

(58) Field of Classification Search
CPC ..... F41A 17/38; F41A 9/59; F41A 35/06
USPC ..... 42/6, 7
See application file for complete search history.

(56) References Cited

U.S. PATENT DOCUMENTS 10,718,581 B2 * 7/2020 Rieger ..... F41A 9/59
2011/0232148 A1 * 9/2011 Cain ..... F41A 17/38 42/6

* cited by examiner

*Primary Examiner* — Reginald S Tillman, Jr.
(74) *Attorney, Agent, or Firm* — Perkins Coie LLP; Andrew T. Pettit; Brian Coleman

(57) ABSTRACT

The present disclosure provides systems and techniques that can be implemented in a gun. The gun may include a magazine retainer that is capable of retaining a magazine within a magazine well of the gun, and the magazine retainer may be operable to controllably release the magazine from the magazine well on demand. The magazine retainer may include a first paddle extending radially in a first direction from an axis of rotation, a second paddle extending radially in the first direction from the axis of rotation, where the axis of rotation is defined through a transverse member of the second paddle, and a catch extending radially in a second direction from the axis of rotation, where the catch is coupled with both the first paddle and the second paddle such that rotating the first paddle or the second paddle results in displacement of the catch.

23 Claims, 10 Drawing Sheets

200

100

200

600

900

1000

WEAPON MAGAZINE RETAINER

CROSS-REFERENCE TO RELATED APPLICATIONS

This application claims priority to U.S. Provisional Application No. 63/211,285, titled "WEAPON MAGAZINE RETAINER" and filed on Jun. 16, 2021, which is incorporated by reference herein in its entirety.

FIELD OF TECHNOLOGY

The teachings disclosed herein generally relate to guns, and more specifically to magazine retainers that can be used in guns.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein provide a magazine retainer that is operable to retain a magazine within a magazine well of a gun and release the magazine from the magazine well of the gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and techniques described herein provide a magazine retainer that can be implemented in a gun. The magazine retainer may include a first paddle extending radially in a first direction from an axis of rotation, a second paddle extending radially in the first direction from the axis of rotation, where the axis of rotation is defined through a transverse member of the second paddle that circumferentially envelopes the axis of rotation, and a magazine catch extending radially in a second direction from the axis of rotation, where the magazine catch is coupled with both the first paddle and the second paddle such that (i) rotating the first paddle results in displacement of the magazine catch and (ii) rotating the second paddle results in displacement of the magazine catch. The second direction may be opposite the first direction. For example, the first paddle and the second paddle may extend towards the muzzle of the gun and the catch may extend towards the grip of the gun.

Figure 1:
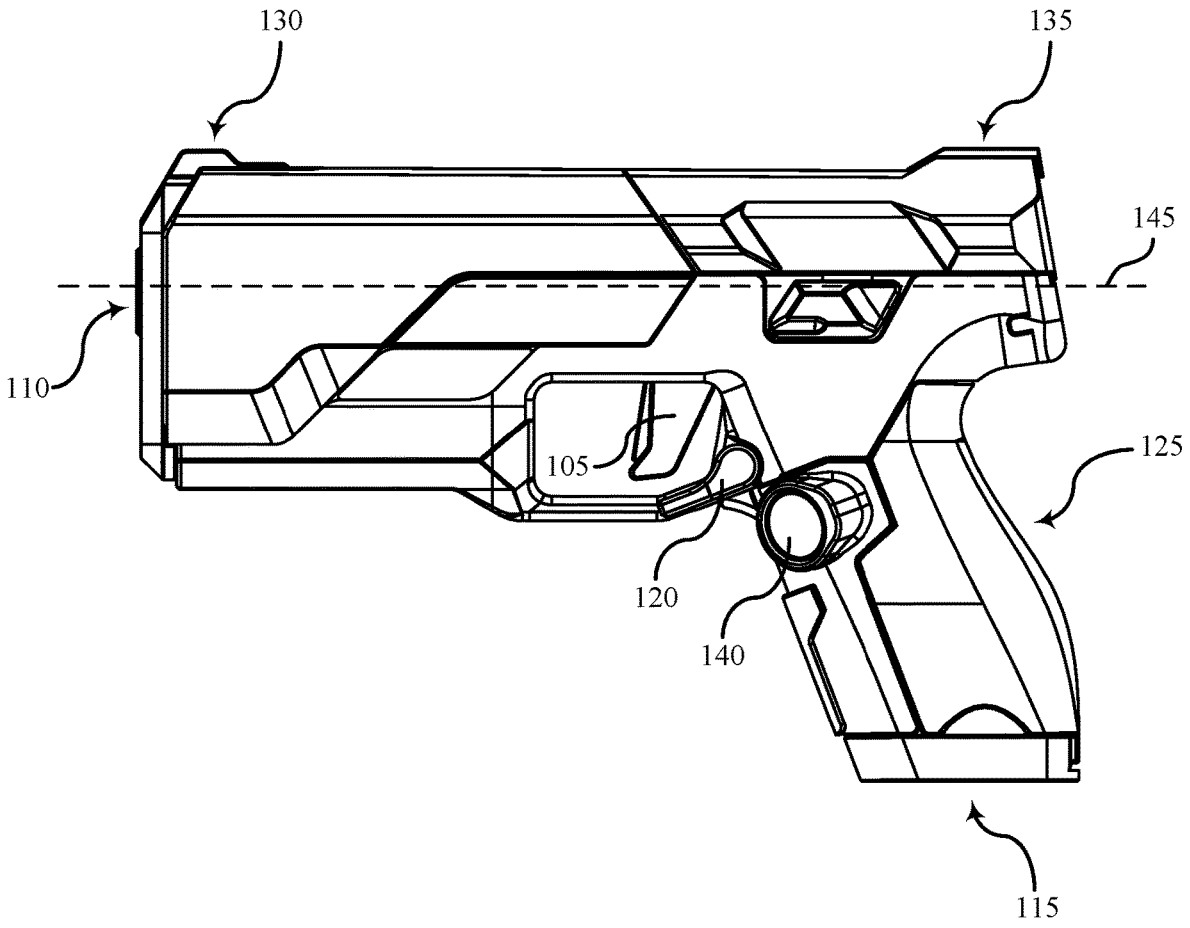
FIG. 1 illustrates an example of a gun that includes a magazine retainer.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Conventional guns can include a magazine retainer that holds an ammunition magazine (or simply "magazine") in the magazine well of the gun such that rounds (also referred to as "cartridges") can be stripped from the magazine and inserted into the chamber of the gun. A conventional magazine retainer is operable to release the magazine in response to an action of a user (also referred to as an "operator") of the gun, such as the user pressing a mechanical button to cause movement of the magazine retainer that results in the release of the magazine from the magazine well. Most conventional magazine retainers are designed for use in mechanical guns, and most conventional magazine retainers are located either on the right or left side of the gun, thereby supporting only right-hand or left-hand operation of the magazine retainer.

Additionally, since mechanical guns do not include electronic components, conventional magazine retainers fail to accommodate electronic components of the gun, such as processors, sensors, or physical communication components including wires, cables, and the like. Since mechanical guns do not include electronic components, conventional magazine retainers are often bulky mechanical components that occupy a large amount of space within the magazine well of the gun.

Introduced here, therefore, are systems that improve the management of ammunition magazines (or simply "magazines"). A magazine retainer (or simply "retainer") is designed to hold a magazine in a magazine well (or simply "well") of a gun, though the retainer may be operable to controllably release the magazine from the well on demand. The well may be a cavity in the gun that is designed—in terms of size and location—for retaining the magazine such that cartridges can be readily stripped therefrom. The magazine retainer may be located in close proximity to electronic components of the gun. For example, when loaded in the magazine well, the magazine retainer may be located near one or more sensors that are embedded in, or installed on, the handle of the gun, as well as cables extending from those sensors to a processor (e.g., installed on a printed circuit board in the upper portion of the grip). However, the magazine retainer may support right-hand and left-hand operation. The magazine retainer may include multiple paddles and a catch. The catch may be configured to contact the magazine and hold the magazine in a fixed location within the magazine well, and rotating either of the paddles may result in displacement of the catch such that the magazine is released from the magazine well.

The magazine retainer holds the magazine in the magazine well by default, and the magazine retainer can release the magazine from the magazine well in response to a user rotating a paddle. The magazine retainer may include two paddles that are mechanically coupled such that rotating one paddle results in rotation of both paddles, thereby supporting ambidextrous use of the magazine retainer. The magazine retainer may be spring loaded such that a magazine that is inserted into the magazine well is automatically held in place within the magazine well by the magazine retainer. The catch (e.g., a lever, a rod, etc.) may be configured to retain the magazine by default and release the magazine in response to movement of the paddles. The location and/or size of the catch may be modified independently from the paddles, thereby improving the configurability of the magazine retainer. The paddles may be positioned in an ergonomically or aesthetically desirable location on the gun, and the size of the catch may be modified independently of the paddles based on a weapon type, a magazine type, or a user preference. For example, the paddles may be position proximate to the trigger guard such that the user can use an index finger to rotate a paddle while maintaining a secure grip on the gun, and the position of the catch may be configured to hold a magazine in the magazine well without impacting the position of the paddles.

The magazine retainer may include a first paddle with a recessed portion, a second paddle with a cylindrical member (e.g., a transverse member) and a recessed portion, a catch with an aperture, a spring configured to maintain a gap between the first paddle and the catch by default, and a retaining pin that couples the first paddle, the second paddle, and the catch. The catch may be configured to retain the magazine while in the default position and release the magazine in response to movement of the first paddle or the second paddle. For example, a portion of the catch may be configured to fit within a recessed portion of the magazine such that the catch contacts the recessed portion of the magazine and holds the magazine within the magazine well of the gun. The interior circumference of the aperture of the catch may be at least as large as the exterior circumference of the cylindrical member of the second paddle. The magazine retainer may be coupled with the gun such that the first paddle (e.g., a right paddle) is located on the right side of the trigger guard and the second paddle (e.g., a left paddle) is located on the left side of the trigger guard. Rotating one paddle or both paddles in a downward direction (e.g., counterclockwise when looking at the left side of the gun and clockwise when looking at the right side of the gun) translates into horizontal displacement of the magazine catch such that the lever moves away from the center of the magazine well, thereby producing a clearance between the catch and the magazine and allowing the magazine to be released from the magazine well of the gun.

Embodiments may be described in the context of executable instructions for the purpose of illustration. For example, a processor housed in a gun may be described as being capable of executing instructions that permit the user to be authenticated based on a biometric identifier, such as a fingerprint or iris. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that includes a magazine retainer that is capable of retaining and releasing a magazine. The gun 100 includes a trigger 105, a barrel 110, a magazine 115, and a magazine retainer 120. While these components are generally found in firearms, such as pistols, rifles, and shotguns, those skilled in the art will recognize that the technology described herein may be similarly applicable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked in based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The magazine retainer 120 may include a first paddle extending radially in a first direction from an axis of rotation, a second paddle extending radially in the first direction from the axis of rotation, where the axis of rotation is defined through a transverse member of the second paddle that circumferentially envelopes the axis of rotation, and a magazine catch extending radially in a second direction from the axis of rotation, where the magazine catch is coupled with both the first paddle and the second paddle such that (i) rotating the first paddle results in displacement of the magazine catch and (ii) rotating the second paddle results in displacement of the magazine catch. The second direction may be opposite the first direction. For example, the first paddle and the second paddle may extend towards the muzzle of the gun and the catch may extend towards the grip of the gun.

Figure 2:
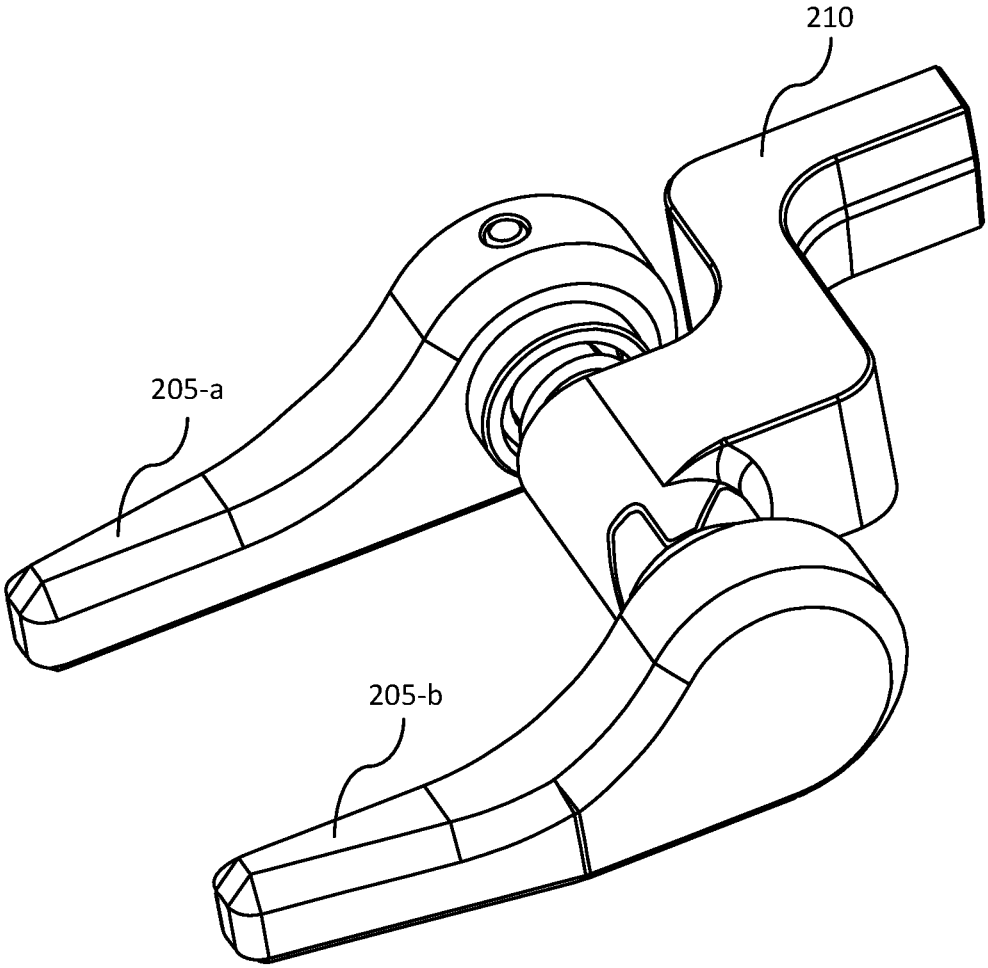
FIG. 2 illustrates an example of a magazine retainer.

FIG. 2 illustrates an example of a magazine retainer 200, and the magazine retainer 200 may be operable to retain and selectively release a magazine. For example, the magazine retainer 200 may be capable of retaining a magazine within a magazine well of a gun and releasing the magazine from the magazine well in response to a user (e.g., an operator) pressing a first paddle 205-*a* or a second paddle 205-*b*.

The magazine retainer 200 includes the first paddle 205-*a* (e.g., a paddle configured to be located on the right side of a trigger guard), a second paddle 205-*b* (e.g., a paddle configured to be located on the left side of a trigger guard), and a catch 210 (e.g., a lever mechanism that is capable of holding a magazine within a magazine well). The catch 210 may be configured to retain a magazine by contacting the magazine at a recessed portion of the magazine (or a magazine cavity). Rotating the first paddle 205-*a* and/or the second paddle 205-*b* causes displacement of the catch 210 in a horizontal direction away from the magazine, thereby creating a gap between the catch 210 and the magazine and allowing the magazine to be released from the magazine well.

The paddles (e.g., the first paddle 205-*a* and the second paddle 205-*b*) may be mechanically coupled such that rotating either one of the paddles results in rotation of both the paddles. Mechanically coupling the paddles in this manner allows the magazine retainer 200 to be operated ambidextrous, thereby improving the usability of the retainer and the gun.

The catch 210 may be configured, modified, swapped, or replaced to support different guns and/or magazines. Some guns may include magazine wells of various dimensions, some guns may include magazine wells that are located at various distances from the trigger guard (or a retainer mounting surface), and the dimensions of magazines (or magazine recesses) may vary. Supporting multiple sizes and dimensions of catches 210 allows the magazine retainer 200 to be used in multiple guns, thereby reducing cost and improving ease of use.

Figure 3:
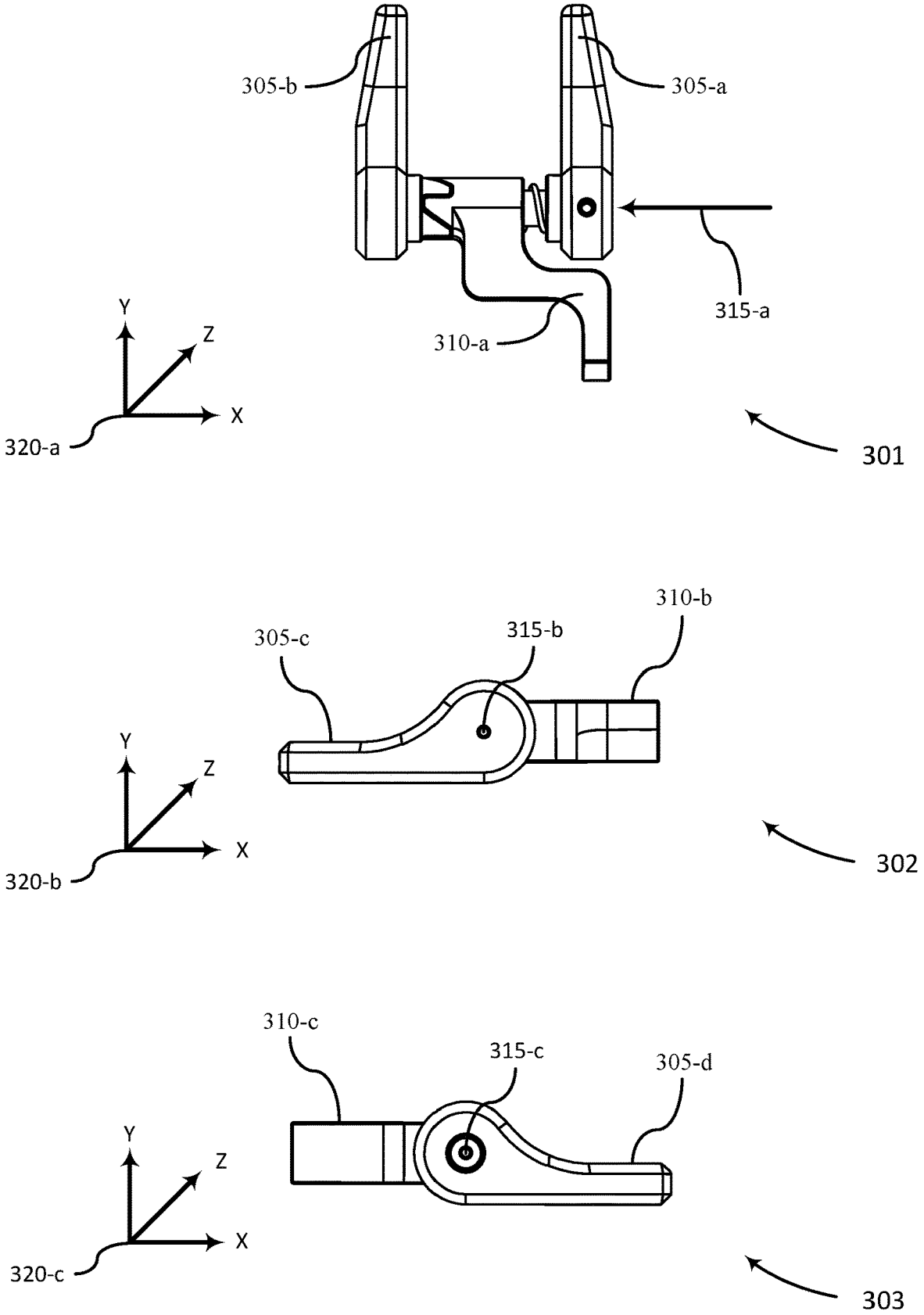
FIG. 3 illustrates examples of various views of magazine retainer.

FIG. 3 illustrates an example of a vertical view of a magazine retainer 301, an example of a left-side view of a magazine retainer 302, and an example of a right-side view of a magazine retainer 303.

The magazine retainer 301 includes a first paddle 305-*a*, a second paddle 305-*b*, and a magazine catch 310-*a*. The legend 320-*a* defines an "X" axis, a "Y" axis, and a "Z" axis which may be referenced herein.

Rotating the first paddle 305-*a* and/or the second paddle 305-*b* about the axis of rotation 315-*a* causes movement of magazine catch 310-*a*. For example, a user may rotate the first paddle 305-*a* about the axis of rotation 315-*a* by rotating the first paddle 305-*a* along the "Z" axis so as to cause movement of the magazine catch 310-*a* along the "X" axis. Rotating the first paddle 305-*a* (or the second paddle 305-*b*) in a first direction (e.g., into the page, a negative direction along the "Z" axis, etc.) causes the magazine catch 310-*a* to be displaced in a positive direction along the "X" axis, and rotating the first paddle 305-*a* (or the second paddle 305-*b*) in a second direction (e.g., out of the page, a positive direction along the "Z" axis, etc.) causes the magazine catch 310-*a* to be displaced in a negative direction along the "X" axis. In other words, rotating the paddles in a first direction about the axis of rotation 315-*a* (e.g., into the page) causes the release of the magazine from the magazine well of the gun, and rotating the paddles in a second direction about the axis of rotation 315-*a* (e.g., out of the page) causes the magazine to be locked in place within the magazine well of the gun. Instead of physically rotating the paddles in the second direction to lock the magazine in place, the paddles may automatically rotate in the second direction based on a spring component of the magazine retainer 301 so as to assume a default position.

The magazine retainer 302 includes a paddle 305-*c* and a magazine catch 310-*b*. The legend 320-*b* defines an "X" axis, a "Y" axis, and a "Z" axis which may be referenced herein. The paddle 305-*c* may be an example of a paddle that is configured to be located on the left side of a gun. For example, the paddle 305-*c* may be an example of a left-side horizontal view of the second paddle 305-*b* described with reference to the magazine retainer 301.

Rotating the paddle 305-*c* about the axis of rotation 315-*b* causes movement of the magazine catch 310-*b*. For example, rotating the paddle 305-*c* about the axis of rotation 315-*b* in a counterclockwise direction (e.g., a negative direction along the "Y" axis and a positive direction along the "X") may cause movement of the magazine catch 310-*b* along the axis of rotation 315-*b* (e.g., into the page, a negative direction along the "Z" axis, etc.). Rotating the paddle 305-*c* about the axis of rotation 315-*b* in a clockwise direction (e.g., a positive direction along the "Y" axis and a positive direction along the "X") may cause movement of the magazine catch 310-*b* along the axis of rotation 315-*b* (e.g., out of the page, a positive direction along the "Z" axis, etc.).

The magazine catch 310-*b* may return to a default position when a user ceases to apply force to the paddle 305-*c*. For example, a user may apply force to the paddle 305-*c* with a thumb or a finger so as to cause the paddle 305-*c* to rotate and the magazine catch 310-*b* to move. Upon releasing the paddle 305-*c*, the paddle 305-*c* may return to the default position based on the spring force of a spring contained within the magazine retainer 302.

The magazine retainer 303 includes a paddle 305-*d* and a magazine catch 310-*c*. The legend 320-*c* defines an "X" axis, a "Y" axis, and a "Z" axis which may be referenced herein. The paddle 305-*d* may be an example of a paddle that is configured to be located on the right side of a gun. For example, the paddle 305-*d* may be an example of a right-side horizontal view of the first paddle 305-*a* described with reference to the magazine retainer 301.

Rotating the paddle 305-*d* about the axis of rotation 315-*c* causes movement of the magazine catch 310-*c*. For example, rotating the paddle 305-*d* about the axis of rotation 315-*c* in a clockwise direction (e.g., a negative direction along the "Y" axis and a negative direction along the "X") may cause movement of the magazine catch 310-*c* along the axis of rotation 315-*c* (e.g., out of the page, a positive direction along the "Z" axis, etc.). Rotating the paddle 305-*d* about the axis of rotation 315-*c* in a counterclockwise direction (e.g., a positive direction along the "Y" axis and a negative direction along the "X") may cause movement of the magazine catch 310-*c* along the axis of rotation 315-*c* (e.g., into the page, a negative direction along the "Z" axis, etc.).

The magazine catch 310-*c* may return to a default position when a user ceases to apply force to the paddle 305-*d*. For example, a user may apply force to paddle 305-*d* with a thumb or a finger so as to cause the paddle 305-*d* to rotate and the magazine catch 310-*c* to move. Upon releasing the paddle 305-*d*, the magazine catch 310-*c* may return to the default position based on the spring force of a spring contained within the magazine retainer 303. In some examples, the spring force may produce a gap between the paddle 305-*d* and the magazine catch 310-*c*, thereby placing the magazine catch 310-*c* in the default position. The default position of the magazine catch 310-*c* may retain, contact, or obstruct a magazine such that the magazine is retained within a magazine well of a gun. An activated position of magazine catch 310-*c* may correspond to a position that does not obstruct the magazine and therefore allows the magazine to be released, and the magazine catch 310-*c* may assume the activated position while a user is actively applying force to the paddle 305-*d*.

Figure 4:
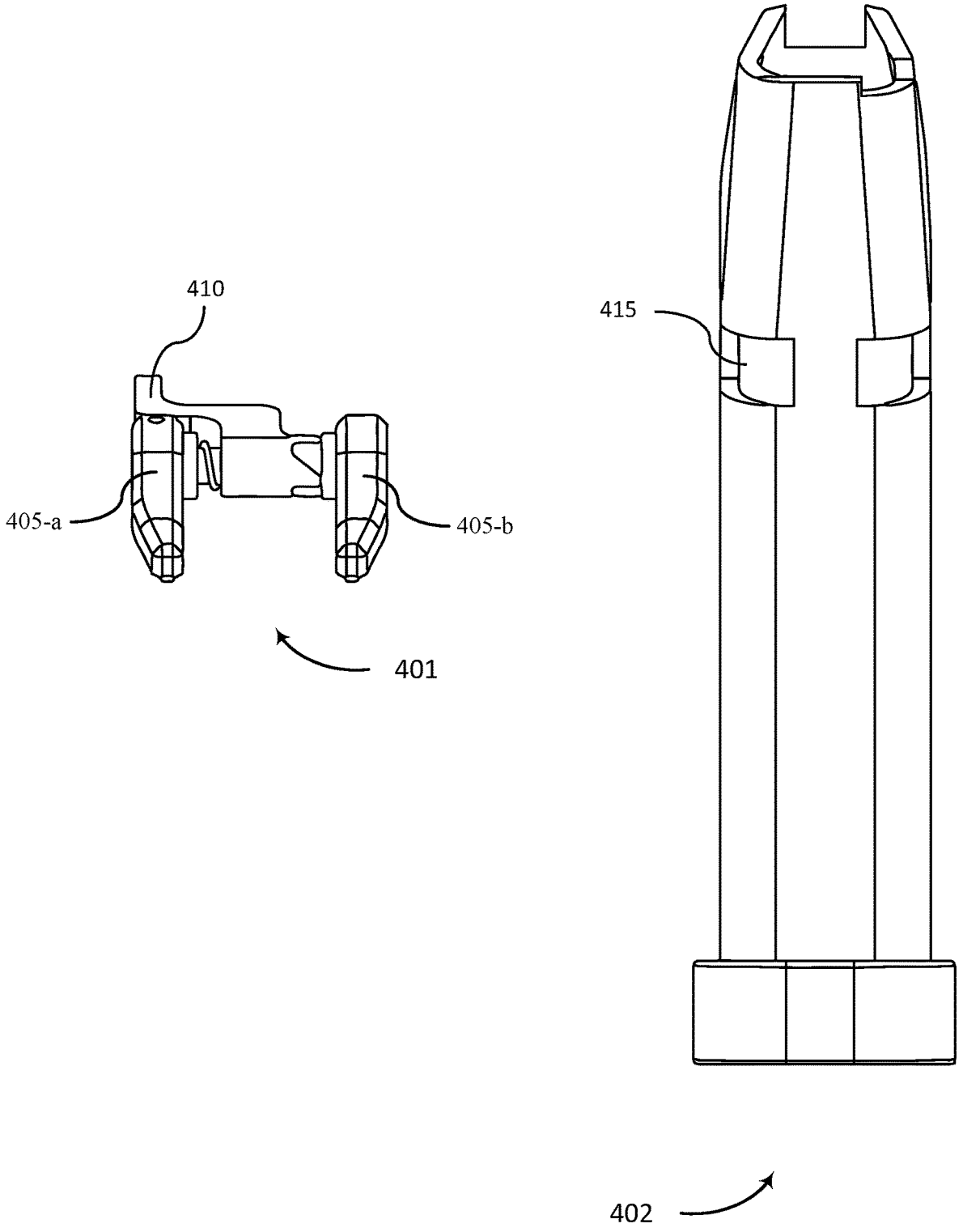
FIG. 4 illustrates an example of a magazine retainer and an example of a magazine.

FIG. 4 illustrates an example of a magazine retainer 401 and a magazine 402. The magazine retainer 401 may be configured to retain the magazine 402 within a magazine well of a gun. The magazine retainer 401 includes a paddle 405-*a*, a paddle 405-*b*, and a catch 410. The magazine 402 includes a recess 415 (e.g., a cavity).

The catch 410 may retain the magazine 402 within a magazine well while in a default position, and the catch 410 may release the magazine 402 from the magazine well based on assuming an activated position. The dimensions of the catch 410 may be configured such that a portion of the catch 410 fits within the recess 415. For example, the exterior dimensions of the catch 410 may be similar to, but smaller than, the interior dimensions of the recess 415. As such, a portion of the catch 410 may fit within the recess 415 and allow the catch 410 to hold the magazine 402 in a stationary position. The dimensions of the catch 410 may be modified to support various weapons, magazines, or magazine recesses. The dimensions of the catch 410 may additionally or alternatively be modified to support weapon components. For example, the weapon may be an electromechanical gun that includes one or more electronic components (e.g., wires, interfaces, sensors, communication channels, buses, etc.), and the dimensions of the catch 410 may be modified to avoid obstruction of the one or more electronic components.

Figure 5:
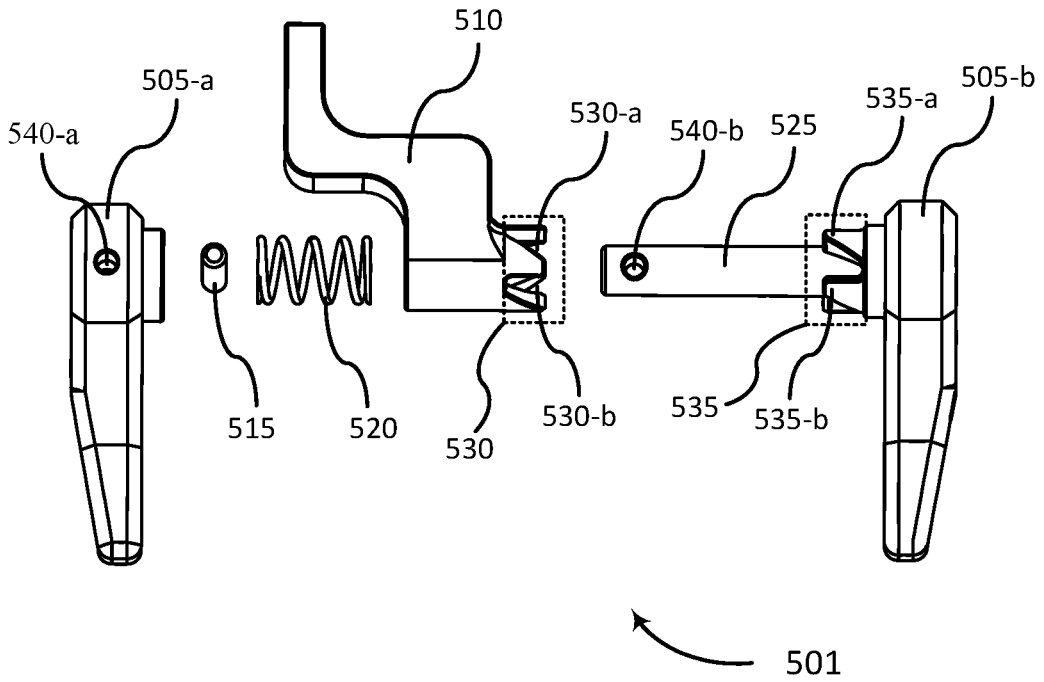
FIG. 5 illustrates an example of a magazine retainer disassembly and an example of a magazine retainer assembly.
Figure 5:
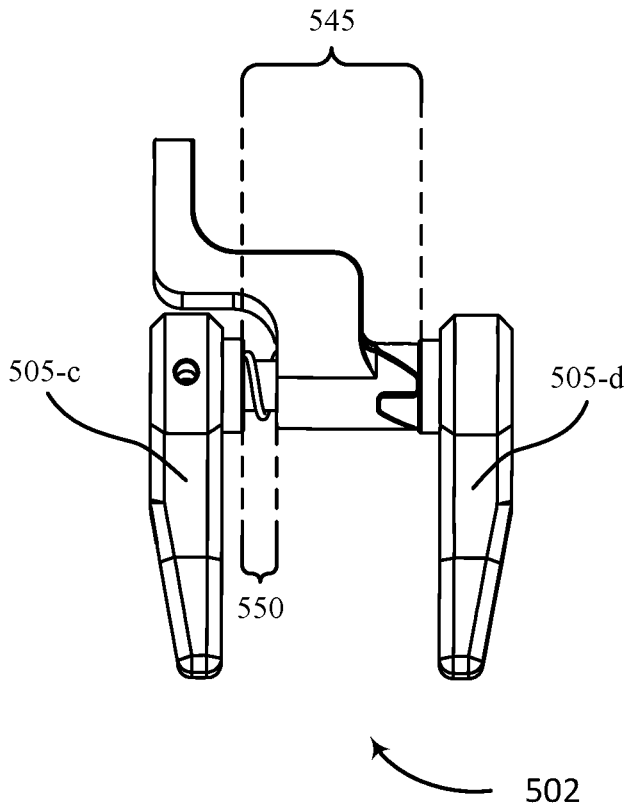

FIG. 5 illustrates an example of a disassembly 501 and an example of an assembly 502. The disassembly 501 is an example a disassembled magazine retainer, and the assembly 502 is an example of an assembled magazine retainer.

The disassembly 501 includes a first paddle 505-*a*, a second paddle 505-*b*, a magazine catch 510, a retaining pin 515, a spring 520, a transverse member 525 of the second paddle 505-*b*, a group of concave cavities 530 including a cavity 530-*a* and a cavity 530-*b*, a group of convex protrusions 535 including a protrusion 535-*a* and a protrusion 535-*b*, a cavity 540-*a* of the first paddle 505-*a*, and a cavity 540-*b* of the transverse member 525.

The size and/or spring force of the spring 520 may be selected or configured for a particular weapon, gun, magazine, magazine recess, or user preference. For example, the length of the spring may be selected based on the length of the transverse member 525, the paddle gap 545, or the catch gap 550. The spring force of the spring 520 may be selected based on a magazine type, a weight, or a user preference (e.g., low-force magazine release or high-force magazine release). In some examples, the dimensions of the magazine catch 510 may be configured independently from the dimensions of the paddles, thereby supporting selecting ergonomic paddle dimensions and locations while allowing the magazine catch 510 to be configured for multiple different magazine types or sizes.

The components of the assembly 502 may be coupled together based on the retaining pin 515. The retaining pin 515 may be an example of, or include components of, a dowl pin, a grooved pin, a spring pin, a slotted pin, a coiled pin, a spiral roll pin, a split pin, an R-clip, a lynch pin, a clevis pin, or any combination thereof.

The paddle gap 545 may be configured based on the size of a trigger guard, as the paddle 505-*c* may be located on a first side (e.g., the right side) of the trigger guard and the paddle 505-*d* may be located on a second side (e.g., the left side) of the trigger guard. The catch gap 550 may correspond to a displacement distance for magazine catch 510. For example, the catch gap 550 may illustrate the distance the magazine catch 510 is displaced while transitioning from a default position to an activated position. The magazine catch 510 may retain the magazine in a magazine well while in the default position, and the magazine catch 510 may allow the release of the magazine while in the activated position.

Figure 6:
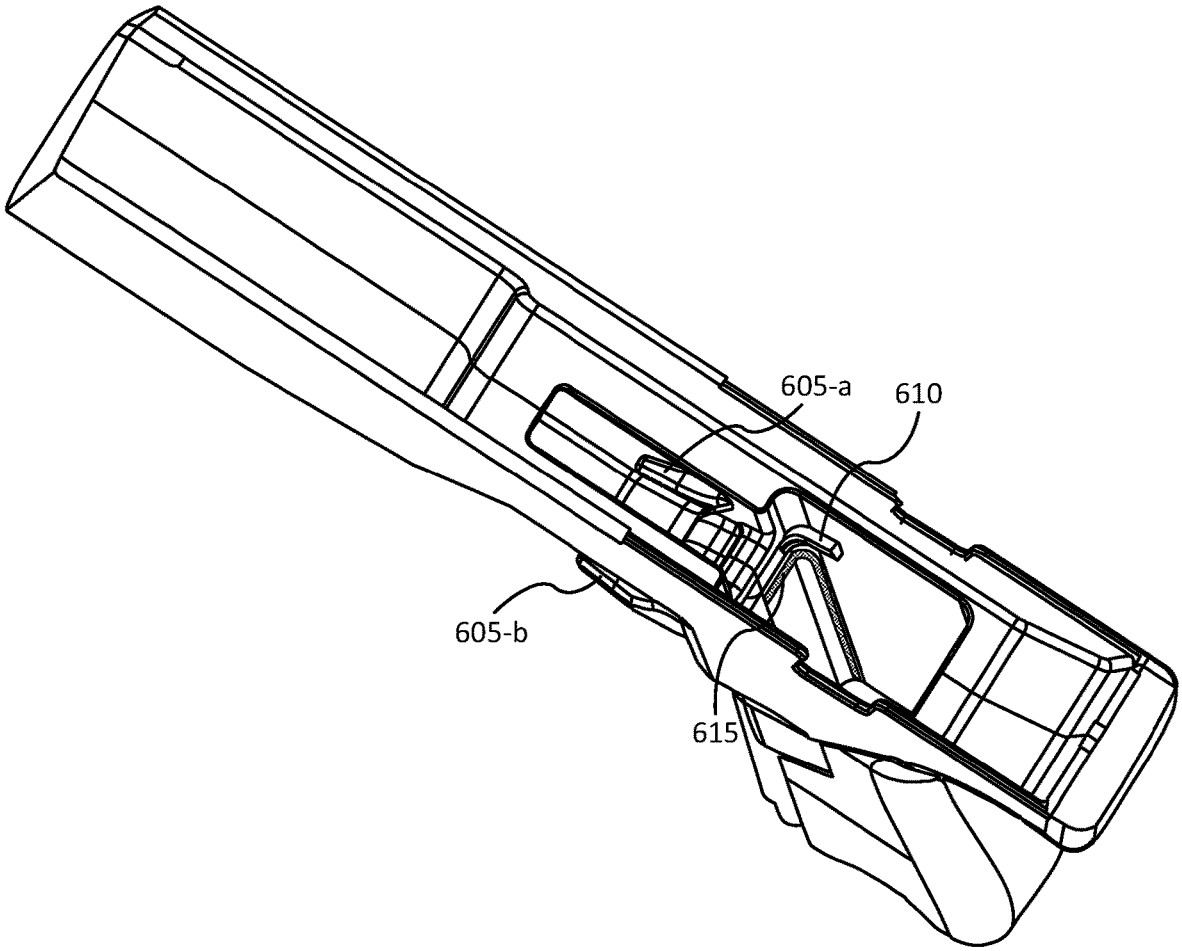
FIG. 6 illustrates an example of a gun frame that includes a magazine retainer positioned within a magazine well.

FIG. 6 illustrates an example of a gun frame 600 that includes a magazine retainer. The gun frame 600 includes a first paddle 605-*a* and a second paddle 605-*b*. The first paddle 605-*a* may be located on the right side of the gun frame 600 and the second paddle 605-*b* may be located on the left side of the gun frame 600. The gun frame 600 illustrates a magazine catch 610 located within a magazine well and proximate to a communication channel 615. The communication channel 615 is an example of an electronic component.

One or more properties of the first paddle 605-*a* and/or the second paddle 605-*b* may be configured for the gun frame 600 or a magazine associated with the gun frame 600. For example, the dimensions of the magazine catch 610 may be configured such that the magazine catch 610 avoids (e.g., does not contact) the communication channel 615 (e.g., a wire or an electronic bus). Other components associated with the magazine retainer, such as a retaining pin or a spring, may be configured based on the gun frame 600 or a magazine associated with the gun frame 600. For example, the retaining pin and the spring may be chosen based on the weight (e.g., the maximum weight) of a magazine that is compatible with the gun frame 600. One or more properties of the magazine catch 610 may be configured or modified without impacting the first paddle 605-*a* or the second paddle 605-*b*, thereby allowing the magazine retainer to be used with magazines of various weights and sizes.

Figure 7:
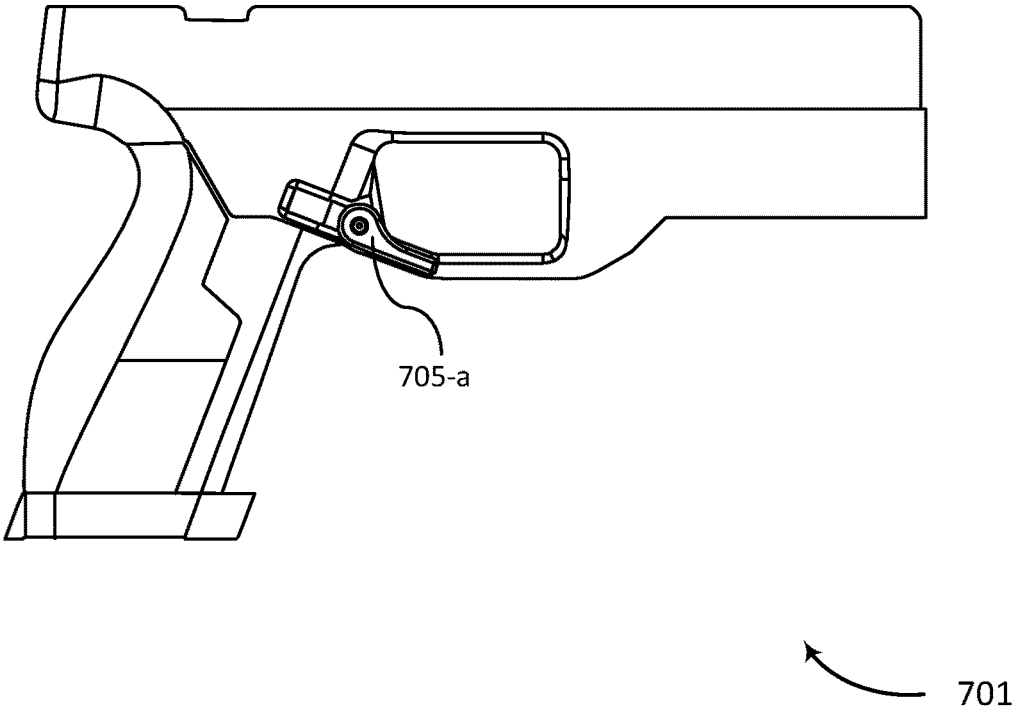
FIG. 7 illustrates a left-side view and a right-side view of a gun that includes a magazine retainer.
Figure 7:
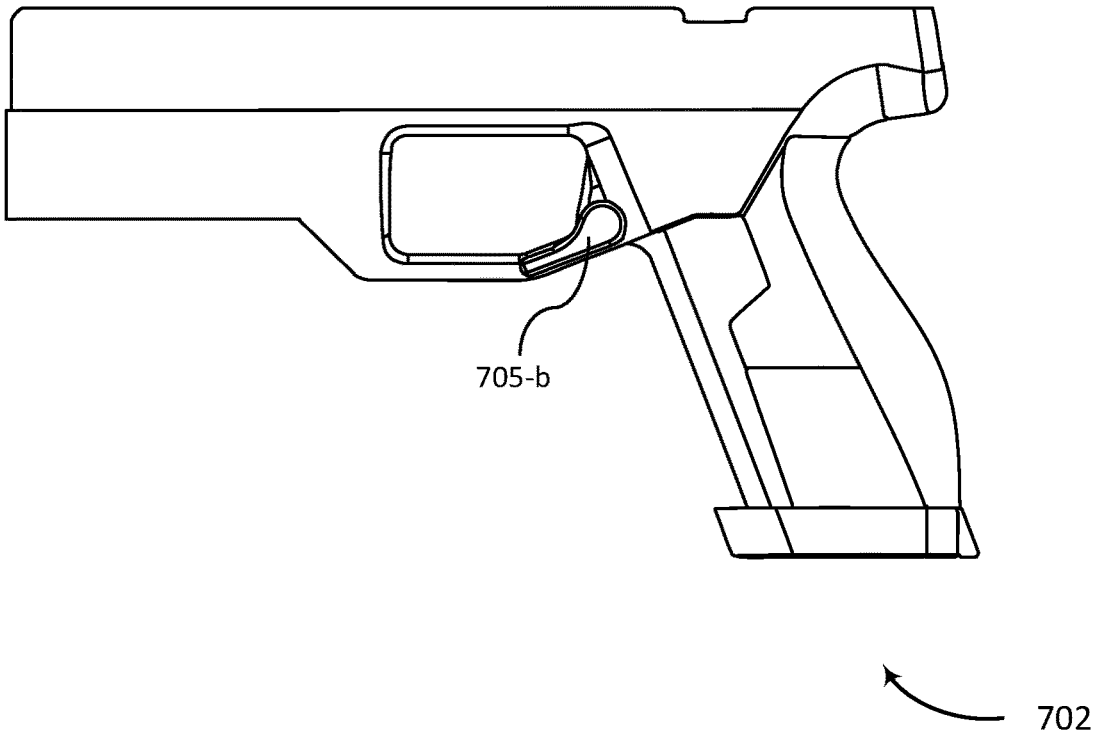

FIG. 7 illustrates an example of a right-side view of a gun 701 that includes a magazine retainer and an example of a left-side view of a gun 702 that includes a magazine retainer. A force threshold and/or a displacement threshold associated with the paddle 705-*a*, the paddle 705-*b*, or both. The force threshold and/or the displacement threshold may be selected based on gun properties, magazine properties, or user preferences. A magazine retainer may release a magazine in response to the force threshold and/or the displacement threshold being satisfied.

The right-side view of the gun 701 includes paddle 705-*a*, and the ease of movement associated with the paddle 705-*a* may be configured by a user by, for example, replacing or modifying a spring associated with the paddle 705-*a*, modifying the length of the paddle 705-*a*, or modifying a default position of the paddle 705-*a*.

The paddle 705-*a* (and/or the paddle 705-*b*) may be associated with a force threshold, and the force threshold may correspond to an amount of force that is sufficient for releasing a magazine. In some examples, the force threshold may be based on a magazine weight. The force threshold may be modified by altering a spring force, a spring size, or a spring material. Some magazines may be associated with a force threshold, and some users may prefer custom force thresholds. For example, a magazine retainer that is capable of retaining a heavy magazine (e.g., a 10-round magazine or a 15-round magazine) may be configured with a force threshold that is higher than a magazine retainer that is capable of retaining light magazine (e.g., a 5 round or a 7 round magazine).

The left-side view of the gun 702 includes a paddle 705-*b*. The size of paddle 705-*b* may be configured based on a dominant hand of a user, a hand size, or a user finger size. The paddle 705-*b* (and/or the paddle 705-*a*) may be associated with a displacement threshold, and the displacement threshold may correspond to an amount of movement that is sufficient for releasing a magazine. The displacement threshold may be based on a magazine size or a magazine recess size. The displacement threshold may be modified by altering the size or location of a magazine catch. The displacement threshold may additionally or alternatively be modified by altering the number and/or size of protrusions and cavities that transfer rotational movement of paddle 705-*b* (and/or the paddle 705-*a*) into horizontal movement of the magazine catch. A paddle may include protrusions and a catch may include cavities, or a paddle may include cavities and a catch may include protrusions. The magazine retainer described herein provides customizable ambidextrous magazine retainer that may be used in multiple guns and with multiple magazines, thereby improving user experience.

Figure 8:
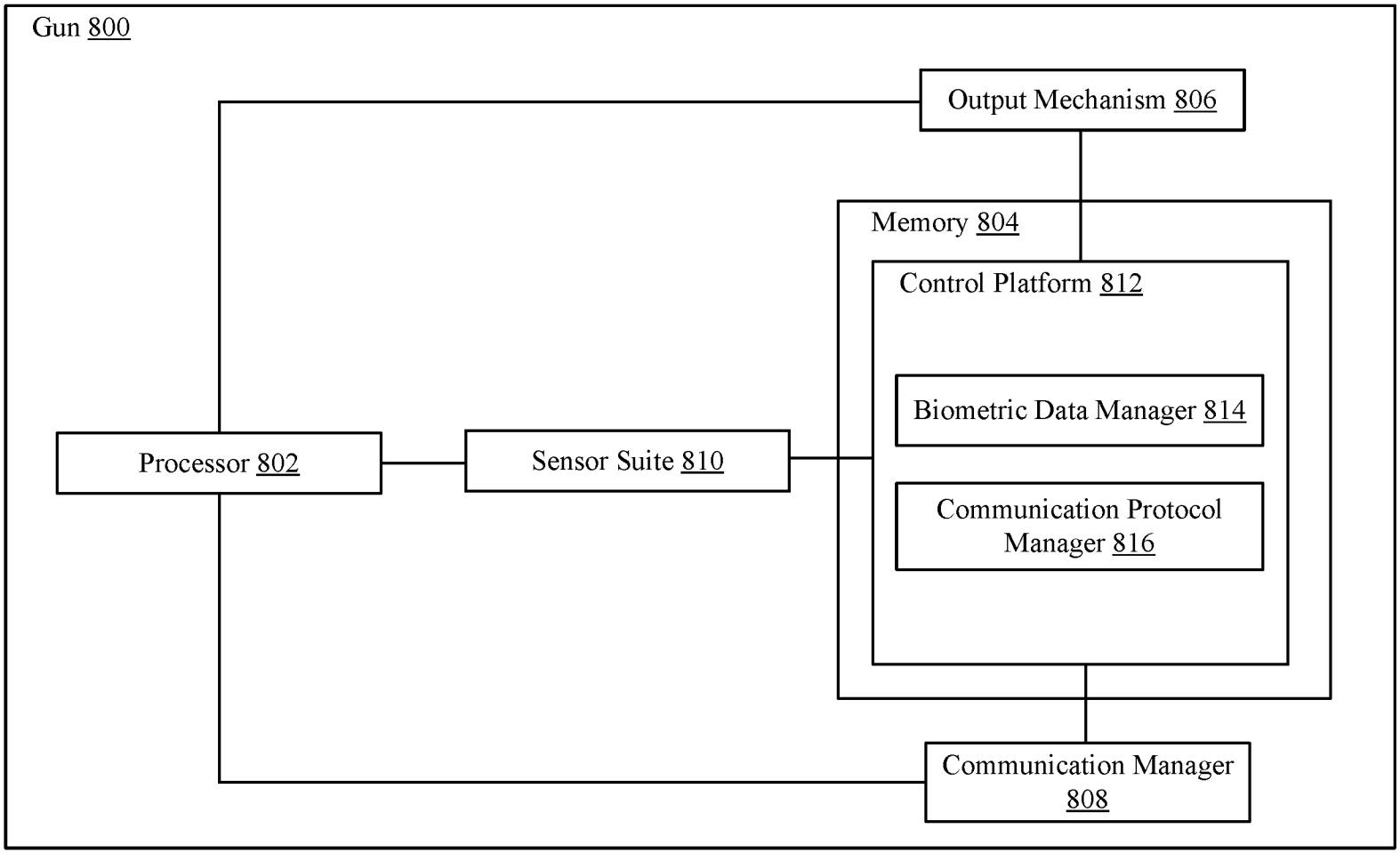
FIG. 8 illustrates an example of a gun that includes both mechanical components and electronic components.

FIG. 8 illustrates an example of a gun 800 that is able to implement a control platform 812 designed to produce outputs that are helpful in facilitating communication between multiple electronic components of the gun 800. As further discussed below, the control platform 812 (also referred to as a "management platform" or a "data manager") may be designed manage data and electronic communication between multiple electronic components of the gun 800.

In some embodiments, the control platform 812 is embodied as a computer program that is executed by the gun 800. In other embodiments, the control platform 812 is embodied as an electrical circuit that performs logical operations of the gun 800. In yet other embodiments, the control platform 812 is embodied as a computer program that is executed by a computing device to which the gun 800 is communicatively connected. In such embodiments, the gun 800 may transmit relevant information to the computing device for processing as further discussed below. Those skilled in the art will recognize that aspects of the computer program could also be distributed amongst the gun 800 and computing device.

The gun 800 can include a processor 802, memory 804, output mechanism 806, and communication manager 808. The processor 802 can have generic characteristics similar to general-purpose processors, or the processor 802 may be an application-specific integrated circuit (ASIC) that provides control functions to the gun 800. As shown in FIG. 8, the processor 802 can be coupled with all components of the gun 800, either directly or indirectly, for communication purposes.

The memory 804 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 802, the memory 804 can also store data generated by the processor 802 (e.g., when executing the managers of the control platform 812). Note that the memory 804 is merely an abstract representation of a storage environment. The memory 804 could be comprised of actual memory chips or managers.

The output mechanism 806 can be any component that is capable of conveying information to a user of the gun 800. For example, the output mechanism 806 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 800. Thus, the display may indicate whether the gun 800 is presently in a locked state, unlocked state, etc. As another example, the output mechanism 806 may be a loudspeaker (or simply "speaker") that is able to audibly convey information to the user.

The communication manager 808 may be responsible for managing communications between the components of the gun 800. Additionally or alternatively, the communication manager 808 may be responsible for managing communications with computing devices that are external to the gun 800. Examples of computing devices include mobile phones, tablet computers, wearable electronic devices (e.g., fitness trackers), and network-accessible server systems comprised of computer servers. Accordingly, the communication manager 808 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 800. Collectively, these sensors may be referred to as the "sensor suite" 810 of the gun 800. For example, the gun 800 may include a motion sensor whose output is indicative of motion of the gun 800 as a whole. Examples of motion sensors include multi-axis accelerometers and gyroscopes. As another example, the gun 800 may include a proximity sensor whose output is indicative of proximity of the gun 800 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 800 may include a fingerprint sensor or camera that generates images which can be used for, for example, biometric authentication. As shown in FIG. 8, outputs produced by the sensor suite 810 may be provided to the control platform 812 for examination or analysis.

For convenience, the control platform 812 may be referred to as a computer program that resides in the memory 804. However, the control platform 812 could be comprised of software, firmware, or hardware components that are implemented in, or accessible to, the gun 800. In accordance with embodiments described herein, the control platform 812 may include a biometric data manager 814 and a communication protocol manager 816. As an illustrative example, the biometric data manager 814 may process data generated by, and obtained from, a fingerprint scanner, and the communication protocol manager 816 may transmit data to, and process data obtained from, a transceiver. In some examples, the gun 800 may include multiple transceivers and the communication protocol manager 816 may implement a communication protocol (e.g., an inter-integrated circuit (I2C) protocol, a serial peripheral interface (SPI) protocol, a universal asynchronous reception and transmission (UART) protocol, etc.) such that the multiple transceivers transmits and receive data according to the communication protocol. Because the data obtained by these managers may have different formats, structures, and content, the instructions executed by these managers can (and often will) be different. For example, the instructions executed by the biometric data manager 814 to process data generated by a fingerprint scanner may be different than the instructions generated by the communication protocol manager 816 to process data generated by a transceiver. As a specific example, the biometric data manager 814 may implement image processing algorithms (e.g., for denoising, despeckling, etc.) that are not necessary for processing data generated by a transceiver.

Figure 9:
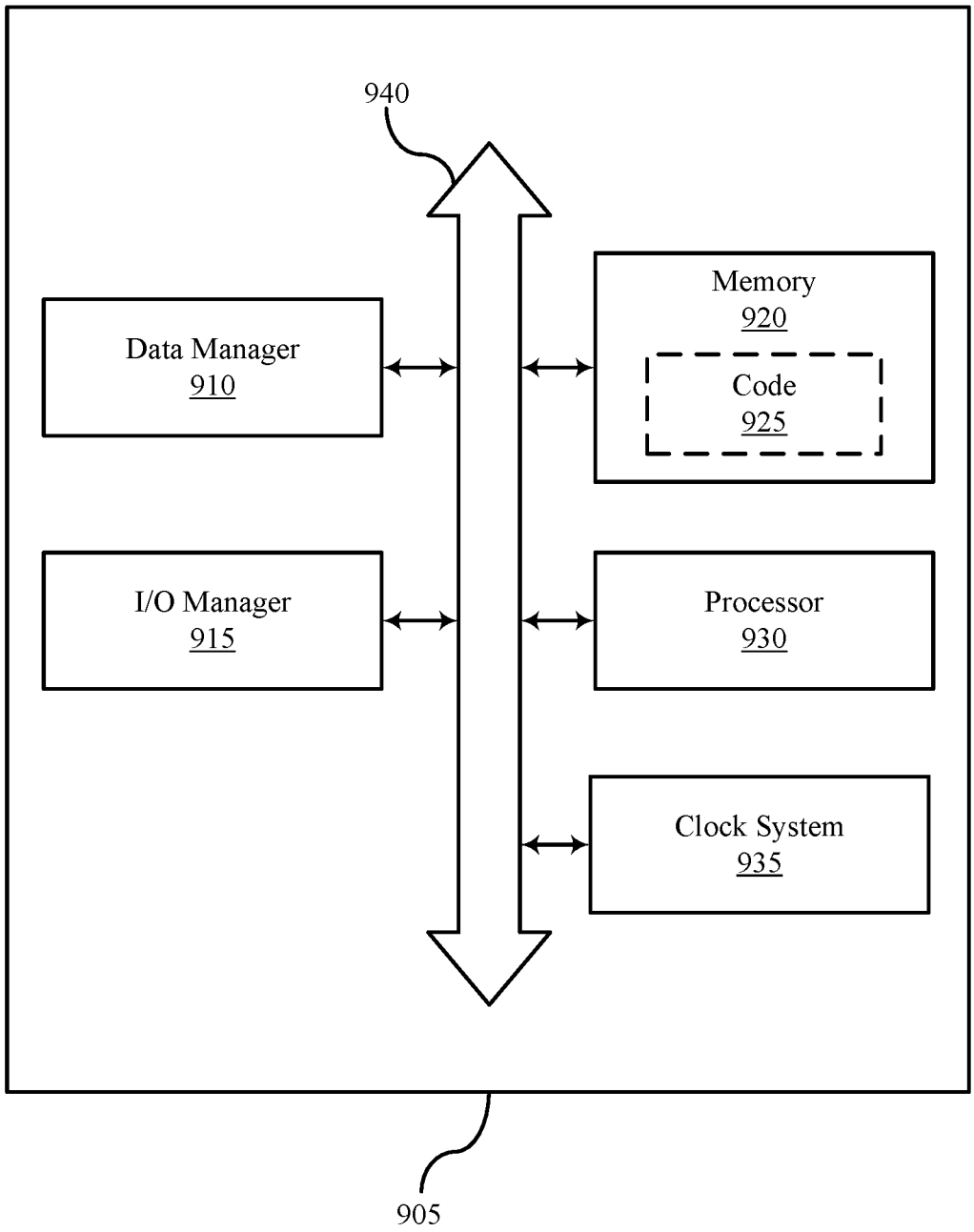
FIG. 9 illustrates an example of a system that may be an aspect of a gun described herein.

FIG. 9 illustrates an example of a system 900 that may be implemented by a gun. The device 905 may be operable to implement the techniques, technology, or systems disclosed herein. The device 905 may include components such as a data manager 910, an input/output (I/O) manager 915, memory 920, code 925, a processor 930, a clock system 935, and a bus 940. The components of the device 905 may communicate via one or more buses 940. The device 905 may be an example of, or include components of, a gun.

The data manager 910 may transmit and/or receive data packets over a physical communication channel, such as a wire or optical cable. The physical communication channel may be located proximate to a magazine retainer, and the magazine retainer may be configured such that the magazine retainer does not obstruct the physical communication channel. As an example, the size or location of a catch of a magazine retainer may be configured such that the catch does not contact the physical communication channel. The magazine retainer described herein can be configured so as to mitigate the potential obstruction of an electronic component, such as a physical communication channel, an electronic sensor, a data manager 910, a processor 930, or the like.

The I/O manager 915 may manage input and output signals for the device 905. The I/O manager 915 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 920 may include or store code (e.g., software) 925. The memory 920 may include volatile memory, such as random-access memory (RAM) and/or non-volatile memory, such as read-only memory (ROM). The code 925 may be computer-readable and computer-executable, and when executed, the code 925 may cause the processor 930 to perform various operations or functions described here.

The processor 930 may be an example or component of a central processing unit (CPU), an application specific integrated circuit (ASIC), or a field programmable gate array (FPGA). In some embodiments, the processor 930 may utilize an operating system or software such as Microsoft Windows®, iOS®, Android®, Linux®, Unix®, or the like. The clock system 935 control a timer for use by the disclosed embodiments.

The data manager 910, or its sub-components, may be implemented in hardware, software (e.g., software or firmware) executed by a processor, or a combination thereof. The data manager 910, or its sub-components, may be physically located in various positions. For example, in some cases, the data manager 910, or its sub-components may be distributed such that portions of functions are implemented at different physical locations by one or more physical components.

Figure 10:
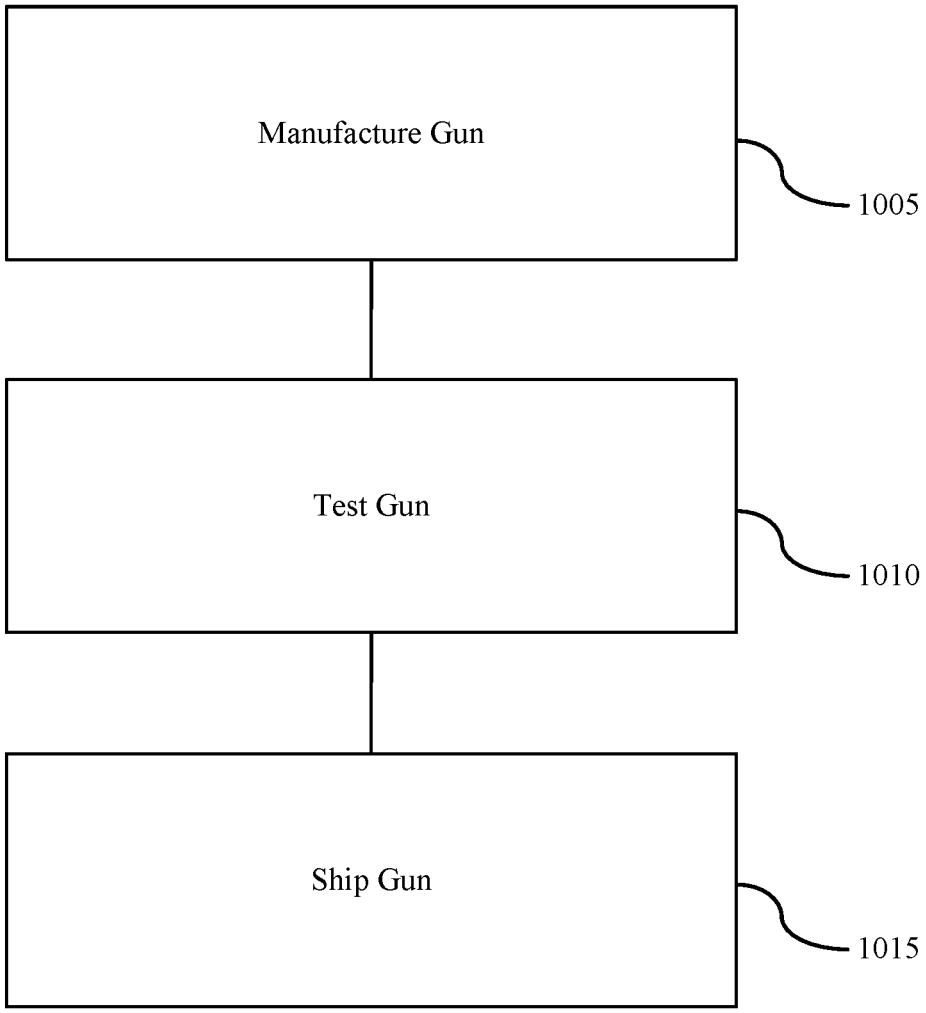
FIG. 10 illustrates an example of a flowchart showing a method of manufacturing a gun that includes a magazine retainer.

FIG. 10 illustrates an example of a flowchart 1000 showing a method of manufacturing a gun that includes a magazine retainer. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1005). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1010). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the magazine retainer to verify that it meets an endurance threshold, the barrel to verify that it meets a precision threshold, and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1015). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1005 and 1010 either sequentially or simultaneously (e.g., one component may be tested while another component is added to the gun). Thus, the descriptions of these processes are intended to be open ended.

Examples

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a gun that includes a magazine well capable of retaining a magazine in which rounds are stored prior to release for discharge through a barrel, the gun including: a pair of paddles that are located on opposing sides of a trigger guard, wherein the pair of paddles are at least partially rotatable about a rotational axis that is orthogonal to a central axis defined through a barrel of the gun, and wherein the pair of paddles includes (i) a first paddle that extends radially away from the rotational axis in a first direction and (ii) a second paddle that extends radially away from the rotational axis in the first direction; and a catch that extends radially away from the rotational axis in a second direction that is roughly opposite the first direction, wherein the catch has a cavity through which a transverse member of the second paddle extends, the transverse member of the second paddle being secured to the first paddle such that the first and second paddles move in conjunction with one another, and wherein the catch is coupled to the first paddle and/or the second paddle such that rotating either of the first paddle or the second paddle about the rotational axis causes displacement of the catch along the rotational axis.

In some examples, the techniques described herein relate to a gun, wherein when the first paddle, the catch, and the second paddle are joined together, structural features along a surface of the catch join with complementary structural features along a surface of the second paddle, such that the catch is stably attached to the second paddle.

In some examples, the techniques described herein relate to a gun, further including: a spring that is in contact with the first paddle and the catch, wherein the spring is configured to maintain a gap between the first paddle and the catch.

In some examples, the techniques described herein relate to a gun that includes a magazine well capable of retaining a magazine in which one or more rounds are stored, the gun including: a first paddle located on a first side of a trigger guard of the gun, wherein the first paddle extends radially in a first direction from an axis of rotation; a second paddle located on a second side of the trigger guard, wherein the second paddle extends radially in the first direction from the axis of rotation, wherein the axis of rotation is defined through a transverse member of the second paddle that extends in a direction that is perpendicular to the first direction, and wherein the transverse member circumferentially envelopes the axis of rotation; a magazine catch extending radially in a second direction from the axis of rotation, wherein the magazine catch is coupled with both the first paddle and the second paddle such that rotating either the first paddle or the second paddle about the axis of rotation causes displacement of the magazine catch along the axis of rotation; a spring enveloping the axis of rotation, wherein the spring is configured to maintain a gap between the first paddle and the magazine catch by default such that the magazine catch protrudes from an interior edge of the magazine well; and a retaining pin located in a cavity of the first paddle and a cavity of the transverse member of the second paddle, wherein the retaining pin couples the first paddle with the second paddle such that (i) rotating the first paddle results in rotation of the second paddle and displacement of the magazine catch and (ii) rotating the second paddle results in rotation of the first paddle and displacement of the magazine catch.

In some examples, the techniques described herein relate to a device capable of retaining a magazine within a magazine well of a gun, the device including: a first paddle extending radially in a first direction from an axis of rotation; a second paddle extending radially in the first direction from the axis of rotation, wherein the axis of rotation is defined through a transverse member of the second paddle; and a magazine catch extending radially in a second direction from the axis of rotation, wherein the magazine catch is coupled with both the first paddle and the second paddle such that (i) rotating the first paddle results in displacement of the magazine catch and (ii) rotating the second paddle results in displacement of the magazine catch.

In some examples, the techniques described herein relate to a device, further including: a spring contacting both the magazine catch and the first paddle such that a gap is maintained between the first paddle and the magazine catch by default, wherein the magazine catch is configured to assume a default position based on the spring.

In some examples, the techniques described herein relate to a device, wherein the default position of the magazine catch is configured such that the magazine catch contacts the magazine and holds the magazine inside the magazine well of the gun while the magazine catch assumes the default position.

In some examples, the techniques described herein relate to a device, wherein the magazine catch is in contact with the second paddle based on the spring.

In some examples, the techniques described herein relate to a device, further including: a retaining pin located inside (i) a cavity of the first paddle and (i) a cavity of the transverse member of the second paddle, wherein the retaining pin couples the first paddle with the second paddle.

In some examples, the techniques described herein relate to a device, wherein the retaining pin is oriented such that the retaining pin is perpendicular to the first direction and the second direction.

In some examples, the techniques described herein relate to a device, wherein the retaining pin is removeable, and wherein removing the retaining pin decouples the first paddle from the second paddle.

In some examples, the techniques described herein relate to a device, wherein when the first paddle, the catch, and the second paddle are joined together, structural features along a surface of the catch join with complementary structural features along a surface of the second paddle, such that the catch is stably attached to the second paddle.

In some examples, the techniques described herein relate to a device, wherein the second paddle includes a group of convex protrusions and the magazine catch includes a group of complimentary concave cavities.

In some examples, the techniques described herein relate to a device, wherein rotating the first paddle about the axis of rotation causes horizontal displacement of the magazine catch along the axis of rotation, and wherein rotating the second paddle about the axis of rotation causes horizontal displacement of the magazine catch along the axis of rotation.

In some examples, the techniques described herein relate to a device, wherein the first paddle is coupled with the second paddle such that rotating the first paddle about the axis of rotation causes the second paddle to rotate about the axis of rotation.

In some examples, the techniques described herein relate to a device, wherein the first paddle is coupled with the second paddle such that rotating the second paddle about the axis of rotation causes the first paddle to rotate about the axis of rotation.

In some examples, the techniques described herein relate to a device, wherein rotating the first paddle in a positive direction about the axis of rotation or rotating the second paddle in the positive direction about the axis of rotation causes displacement of the magazine catch in a positive horizontal direction.

In some examples, the techniques described herein relate to a device, wherein the first paddle is rotated in the positive direction about the axis of rotation such that a magazine catch displacement threshold is satisfied or wherein the second paddle is rotated in the positive direction about the axis of rotation such that the magazine catch displacement threshold is satisfied, and wherein the magazine catch displacement threshold corresponds to a displacement threshold that is sufficient for releasing a magazine.

In some examples, the techniques described herein relate to a device, wherein, when viewing a left side of the gun, the positive direction about the axis of rotation is counterclockwise.

In some examples, the techniques described herein relate to a device, wherein rotating the first paddle in a negative direction about the axis of rotation or rotating the second paddle in the negative direction about the axis of rotation causes the magazine catch to be displaced in a negative horizontal direction.

In some examples, the techniques described herein relate to a device, wherein the first paddle is rotated in the negative direction about the axis of rotation such that a magazine catch displacement threshold is satisfied or wherein the second paddle is rotated in the negative direction about the axis of rotation such that the magazine catch displacement threshold is satisfied, and wherein the magazine catch displacement threshold corresponds to a displacement threshold that is sufficient for retaining a magazine.

In some examples, the techniques described herein relate to a device, wherein, when viewing a left side of the gun, the negative direction about the axis of rotation is clockwise for the first paddle and the second paddle.

In some examples, the techniques described herein relate to a device, wherein a default position of the magazine catch is configured based on a weapon type, a gun type, a magazine type, a magazine cavity, a mechanical gun component, an electronic gun component, or any combination thereof.

In some examples, the techniques described herein relate to a device, wherein a size of the magazine catch corresponds to a size of a magazine cavity such that a portion of the magazine catch fits within the magazine cavity.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a data manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A gun that includes a magazine well capable of retaining a magazine in which rounds are stored prior to release for discharge through a barrel, the gun comprising:

a pair of paddles that are located on opposing sides of a trigger guard, wherein the pair of paddles are at least partially rotatable about a rotational axis that is orthogonal to a central axis defined through the barrel of the gun, and wherein the pair of paddles includes (i) a first paddle that extends radially away from the rotational axis in a first direction and (ii) a second paddle that extends radially away from the rotational axis in the first direction; and a catch that extends radially away from the rotational axis in a second direction that is roughly opposite the first direction, wherein the catch has a cavity through which a transverse member of the second paddle extends, the transverse member of the second paddle being secured to the first paddle such that the first and second paddles move in conjunction with one another, and wherein the catch is coupled to the first paddle and/or the second paddle such that rotating either of the first paddle or the second paddle about the rotational axis causes displacement of the catch along the rotational axis.

2. The gun of claim 1, wherein when the first paddle, the catch, and the second paddle are joined together, structural features along a surface of the catch join with complementary structural features along a surface of the second paddle, such that the catch is stably attached to the second paddle.

3. The gun of claim 1, further comprising:

a spring that is in contact with the first paddle and the catch, wherein the spring is configured to maintain a gap between the first paddle and the catch.

4. A gun that includes a magazine well capable of retaining a magazine in which one or more rounds are stored, the gun comprising:

a first paddle located on a first side of a trigger guard of the gun, wherein the first paddle extends radially in a first direction from an axis of rotation;

a second paddle located on a second side of the trigger guard, wherein the second paddle extends radially in the first direction from the axis of rotation, wherein the axis of rotation is defined through a transverse member of the second paddle that extends in a direction that is perpendicular to the first direction, and wherein the transverse member circumferentially envelopes the axis of rotation;

a magazine catch extending radially in a second direction from the axis of rotation, wherein the magazine catch is coupled with both the first paddle and the second paddle such that rotating either the first paddle or the second paddle about the axis of rotation causes displacement of the magazine catch along the axis of rotation;

a spring enveloping the axis of rotation, wherein the spring is configured to maintain a gap between the first paddle and the magazine catch by default such that the magazine catch protrudes from an interior edge of the magazine well; and a retaining pin located in a cavity of the first paddle and a cavity of the transverse member of the second paddle, wherein the retaining pin couples the first paddle with the second paddle such that (i) rotating the first paddle results in rotation of the second paddle and displacement of the magazine catch and (ii) rotating the second paddle results in rotation of the first paddle and displacement of the magazine catch.

5. A device capable of retaining a magazine within a magazine well of a gun, the device comprising:

a first paddle extending radially in a first direction from an axis of rotation;

a second paddle extending radially in the first direction from the axis of rotation, wherein the axis of rotation is defined through a transverse member of the second paddle;

a magazine catch extending radially in a second direction from the axis of rotation, wherein the magazine catch is coupled with both the first paddle and the second paddle such that (i) rotating the first paddle results in displacement of the magazine catch and (ii) rotating the second paddle results in displacement of the magazine catch; and a spring contacting both the magazine catch and the first paddle such that a gap is maintained between the first paddle and the magazine catch by default, wherein the magazine catch is configured to assume a default position based on the spring.

6. The device of claim 5, wherein the default position of the magazine catch is configured such that the magazine catch contacts the magazine and holds the magazine inside the magazine well of the gun while the magazine catch assumes the default position.

7. The device of claim 5, wherein the magazine catch is in contact with the second paddle based on the spring.

8. A device capable of retaining a magazine within a magazine well of a gun, the device comprising:

a first paddle extending radially in a first direction from an axis of rotation;

a second paddle extending radially in the first direction from the axis of rotation, wherein the axis of rotation is defined through a transverse member of the second paddle;

a magazine catch extending radially in a second direction from the axis of rotation, wherein the magazine catch is coupled with both the first paddle and the second paddle such that (i) rotating the first paddle results in displacement of the magazine catch and (ii) rotating the second paddle results in displacement of the magazine catch; and a retaining pin located inside (i) a cavity of the first paddle and (i) a cavity of the transverse member of the second paddle, wherein the retaining pin couples the first paddle with the second paddle.

9. The device of claim 8, wherein the retaining pin is oriented such that the retaining pin is perpendicular to the first direction and the second direction.

10. The device of claim 8, wherein the retaining pin is removeable, and wherein removing the retaining pin decouples the first paddle from the second paddle.

11. The device of claim 5, wherein when the first paddle, the magazine catch, and the second paddle are joined together, structural features along a surface of the magazine catch join with complementary structural features along a surface of the second paddle, such that the magazine catch is stably attached to the second paddle.

12. The device of claim 5, wherein the second paddle comprises a group of convex protrusions and the magazine catch comprises a group of complementary concave cavities.

13. A device capable of retaining a magazine within a magazine well of a gun, the device comprising:

a first paddle extending radially in a first direction from an axis of rotation;

a second paddle extending radially in the first direction from the axis of rotation, wherein the axis of rotation is defined through a transverse member of the second paddle, wherein the second paddle comprises a group of convex protrusions; and a magazine catch extending radially in a second direction from the axis of rotation, wherein the magazine catch comprises a group of concave cavities complementary to the group of convex protrusions, and wherein the magazine catch is coupled with both the first paddle and the second paddle such that (i) rotating the first paddle results in displacement of the magazine catch and (ii) rotating the second paddle results in displacement of the magazine catch;

wherein rotating the first paddle about the axis of rotation causes horizontal displacement of the magazine catch along the axis of rotation, and wherein rotating the second paddle about the axis of rotation causes horizontal displacement of the magazine catch along the axis of rotation.

14. The device of claim 5, wherein the first paddle is coupled with the second paddle such that rotating the first paddle about the axis of rotation causes the second paddle to rotate about the axis of rotation.

15. The device of claim 5, wherein the first paddle is coupled with the second paddle such that rotating the second paddle about the axis of rotation causes the first paddle to rotate about the axis of rotation.

16. A device capable of retaining a magazine within a magazine well of a gun, the device comprising:

a first paddle extending radially in a first direction from an axis of rotation;

a second paddle extending radially in the first direction from the axis of rotation, wherein the axis of rotation is defined through a transverse member of the second paddle; and a magazine catch extending radially in a second direction from the axis of rotation, wherein the magazine catch is coupled with both the first paddle and the second paddle such that (i) rotating the first paddle results in displacement of the magazine catch and (ii) rotating the second paddle results in displacement of the magazine catch;

wherein rotating the first paddle in a positive direction about the axis of rotation or rotating the second paddle in the positive direction about the axis of rotation causes displacement of the magazine catch in a positive horizontal direction.

17. The device of claim 16, wherein the first paddle is rotated in the positive direction about the axis of rotation such that a magazine catch displacement threshold is satisfied or wherein the second paddle is rotated in the positive direction about the axis of rotation such that the magazine catch displacement threshold is satisfied, and wherein the magazine catch displacement threshold corresponds to a displacement threshold that is sufficient for releasing the magazine.

18. The device of claim 16, wherein, when viewing a left side of the gun, the positive direction about the axis of rotation is counterclockwise.

19. A device capable of retaining a magazine within a magazine well of a gun, the device comprising:

a first paddle extending radially in a first direction from an axis of rotation;

a second paddle extending radially in the first direction from the axis of rotation, wherein the axis of rotation is defined through a transverse member of the second paddle; and a magazine catch extending radially in a second direction from the axis of rotation, wherein the magazine catch is coupled with both the first paddle and the second paddle such that (i) rotating the first paddle results in displacement of the magazine catch and (ii) rotating the second paddle results in displacement of the magazine catch;

wherein rotating the first paddle in a negative direction about the axis of rotation or rotating the second paddle in the negative direction about the axis of rotation causes the magazine catch to be displaced in a negative horizontal direction.

20. The device of claim 19, wherein the first paddle is rotated in the negative direction about the axis of rotation such that a magazine catch displacement threshold is satisfied or wherein the second paddle is rotated in the negative direction about the axis of rotation such that the magazine catch displacement threshold is satisfied, and wherein the magazine catch displacement threshold corresponds to a displacement threshold that is sufficient for retaining the magazine.

21. The device of claim 19, wherein, when viewing a left side of the gun, the negative direction about the axis of rotation is clockwise for the first paddle and the second paddle.

22. The device of claim 19, wherein a default position of the magazine catch is configured based on a weapon type, a gun type, a magazine type, a magazine cavity, a mechanical gun component, an electronic gun component, or any combination thereof.

23. The device of claim 5, wherein a size of the magazine catch corresponds to a size of a magazine cavity such that a portion of the magazine catch fits within the magazine cavity.

* * * * *